US008444132B2

(12) United States Patent
Curley et al.

(10) Patent No.: US 8,444,132 B2
(45) Date of Patent: May 21, 2013

(54) SPRING LOADED CORRUGATED STITCHER HEAD AND METHOD OF STITCHING

(75) Inventors: Richard Daniel Curley, Dover, NH (US); Warren Hess Jarrard, Famington, NH (US)

(73) Assignee: Goss International Americas, Inc., Durham, NH (US)

( * ) Notice: Subject to any disclaimer, the term of this patent is extended or adjusted under 35 U.S.C. 154(b) by 0 days.

(21) Appl. No.: 13/364,534

(22) Filed: Feb. 2, 2012

(65) Prior Publication Data

US 2012/0139177 A1 Jun. 7, 2012

Related U.S. Application Data

(62) Division of application No. 12/806,033, filed on Aug. 4, 2010, now Pat. No. 8,128,080.

(60) Provisional application No. 61/231,523, filed on Aug. 5, 2009.

(51) Int. Cl.
*B65H 37/04* (2006.01)

(52) U.S. Cl.
USPC ..... 270/52.18; 270/58.08

(58) Field of Classification Search
USPC ..... 270/52.18, 58.08; 227/82, 88, 89, 227/90
See application file for complete search history.

(56) References Cited

U.S. PATENT DOCUMENTS

| | | | | | |
|---|---|---|---|---|---|
| 1,152,534 | A * | 9/1915 | Mears et al. | ..... | 227/89 |
| 2,635,234 | A * | 4/1953 | Reed | ..... | 227/84 |
| 2,839,753 | A * | 6/1958 | Reed et al. | ..... | 227/83 |
| 4,196,835 | A | 4/1980 | Schlough | | |
| 4,444,347 | A | 4/1984 | Males | | |
| 4,537,342 | A | 8/1985 | McCain et al. | | |
| 4,708,277 | A | 11/1987 | Schlough | | |
| 5,098,002 | A | 3/1992 | Hansch et al. | | |
| 5,361,962 | A | 11/1994 | Andersen et al. | | |
| 7,032,898 | B2 | 4/2006 | Silberbauer | | |
| 7,159,746 | B2 | 1/2007 | Duff | | |
| 7,337,937 | B2 | 3/2008 | Klamt et al. | | |
| 7,588,240 | B2 * | 9/2009 | Guaraldi et al. | ..... | 270/52.18 |
| 2005/0188468 | A1 | 9/2005 | Crawford | | |
| 2006/0150838 | A1 | 7/2006 | Hollings et al. | | |
| 2007/0069443 | A1 | 3/2007 | Brunner et al. | | |
| 2009/0085272 | A1 | 4/2009 | Brunner et al. | | |

* cited by examiner

*Primary Examiner* — Leslie A Nicholson, III
(74) *Attorney, Agent, or Firm* — Davidson, Davidson & Kappel, LLC

(57) ABSTRACT

A stitching head is provided for stitching books or printed products. The stitching head includes a supporter and a driver. The supporter has a corrugated supporter surface including first ridges and first grooves. The driver interacts with the supporter and has a channel and a corrugated driver surface which includes second ridges and second grooves. The first grooves and first ridges of the supporter mesh with the second ridges and second grooves of driver and the channel supports stitching material between the corrugated supporter surface and the corrugated driver surface. A method is also provided.

13 Claims, 16 Drawing Sheets

| | | | | |
|---|---|---|---|---|
| - | 63 | WP620909 | PIN, DOWEL, .250 X 2.00 | 1 |
| - | 62 | WP607651 | PIN, DOWEL, .250 X 1.25 | 1 |
| - | 61 | FGOPIN-1022 | PIN, DOWEL, .250 X .975 | 4 |
| - | 60 | WP1001141 | PIN, DOWEL, .250 X .50 | 1 |
| - | 59 | WP1014829 | PIN, DOWEL, .250 X .75 | 2 |
| - | 58 | FG0013-0900 | PIN, DOWEL, .1875 X .4375 | 1 |
| - | 57 | FG448-1075 | PIN, DOWEL, .125 X .25 | 2 |
| - | 56 | FG5825573 | PIN, DOWEL, .1252 DIA X .437 LG | 1 |
| - | 55 | WP872771 | PIN, SPRING, COILED, STANDARD .125 X .625 LG | 1 |
| - | 54 | WP5622556 | PIN, DOWEL, 3MM X 10MM | 1 |
| - | 53 | FGFS25-109 | PIN, PIVOT. | 1 |
| - | 52 | FGFS25-134 | PIN, GROOVED. | 3 |
| - | 51 | FGFS25-132 | PIN, GROOVED. | 2 |
| - | 50 | WP5335342 | SHCS, 1/4-20UNC X 4.00. | 2 |
| - | 49 | WP650098 | SHCS, 1/4-20UNC X 1.00. | 1 |
| - | 48 | WP870506 | SHCS, 1/4-20UNC X .250. | 6 |
| - | 47 | WP872233 | SHCS, .10-32UNF X .625. | 2 |
| - | 46 | WP871097 | SHCS, .10-32UNF X .500. | 1 |
| - | 45 | FG440-0028 | SHCS, .10-32UNF X .25. | 2 |
| - | 44 | WP871611 | SHCS, .8-32UNF X .50. | 1 |
| - | 43 | WP871679 | SHCS, .8-ZOUNC X .375. | 1 |
| - | 42 | GO8570305 | SCREW, SET, CUP POINT, M3 X 5 | 1 |
| - | 41 | WP1028663 | SHOULDER SCREW, .312 X .375 LG | 2 |
| - | 40 | WP872107 | SET SCREW, CUP POINT, .10-32UNF X .25 | 2 |
| - | 39 | WP919157 | .10 REGULAR LOCK WASHER. | 1 |
| - | 38 | WP919185 | WASHER, LOCK, HI-COLLAR .8. | 1 |
| - | 37 | FG0085-0267 | BUSHING, DRILL, CARBIDE | 1 |
| - | 36 | FG081-0019 | SPRING, COMPRESS, .12 00 X .62 LG | 1 |
| - | 35 | FG106-01-8038 | STANDARD ROLL. | 1 |
| - | 34 | FG154-0019 | BALL BEARING, .50 X 1.125 X 0.375 | 2 |
| - | 33 | FG190-0240 | E-RING TRUARC 5133-25. | 5 |
| - | 32 | FG5494140 | WIRE GUIDE. | 2 |

A B

FIG. 15

A B

| BOM CHG | ITEM | PART NUMBER | DESCRIPTION | QTY |
|---|---|---|---|---|
| - | 31 | FG5718782 | WIRE GRIPPER. | 1 |
| - | 30 | FG5718783 | WIRE CLAW. | 1 |
| - | 29 | FG5760793 | BLOCK, TUBE HOLDER | 1 |
| - | 28 | FG5760796 | CARTRIDGE, CARSTICK, 1/8 00 TUBING | 1 |
| - | 27 | FG5792248 | WIRE DRIVER, 25 GAUGE, .50 CROWN REFLEX HEAD | 1 |
| - | 26 | FG5825512 | SUPPORTER. | 1 |
| - | 25 | FG5825576 | WASHER, BELLEVILLE, 8.40 X 3.20 X .33 | 9 |
| - | 24 | FG5825586 | SUPPORTER, .50 CROWN, STITCHER HEAD | 1 |
| - | 23 | FGFS25-102 | PLATE, CRANK DRIVE. | 1 |
| - | 22 | FGFS25-103 | PLATE, CRANK DRIVE. | 1 |
| - | 21 | FGFS25-111 | PIVOT STUD. | 1 |
| - | 20 | FGFS25-115 | CLAMP. | 2 |
| - | 19 | FGFS25-118 | SUPPORTER LINK. | 1 |
| - | 18 | FGFS25-120 | WIRE CLAW LINK. | 1 |
| - | 17 | FGFS25-125 | CLAMP PIN. | 1 |
| - | 16 | FGFS25-126 | SPACER PLATE. | 1 |
| - | 15 | FGFS25-127 | SPACER. | 2 |
| - | 14 | FGFS25-128 | SPACER. | 2 |
| - | 13 | FGFS25-129 | SPACER. | 1 |
| - | 12 | FGFS25-131 | BLOCK, DRIVER. | 1 |
| - | 11 | FGFS25-148 | FORMER LINK, CUTTER DRIVE LEVER | 2 |
| - | 10 | FGFS25-149 | FORMER LINK. | 1 |
| - | 09 | FGFS25-152A | CUTTER BLOCK. | 1 |
| - | 08 | FGFS25-153B | CUTTER BLADE. | 1 |
| - | 07 | FGFS25-156 | CUTTER DRIVE LINK. | 1 |
| - | 06 | FGFS25-157 | LEVER, WIRE GRIPPER | 1 |
| - | 05 | FGFS25-161 | PLATE, .50 CROWN. | 1 |
| - | 04 | FGFS25-164 | PIVOT, CUTTER 1.50¯1. | 1 |
| - | 03 | FGFS25-166 | SPACER. | 3 |
| - | 02 | FGFS25-167 | LINK, DRIVER 1.50¯1. | 1 |
| - | 01 | WPFS25-162 | FORMER - .23 11/21. | 1 |

FIG. 15(Cont.)

SPRING LOADED CORRUGATED STITCHER HEAD AND METHOD OF STITCHING

CROSS-REFERENCE TO RELATED APPLICATIONS

This is a continuation of U.S. application Ser. No. 12/806,033 filed Aug. 4, 2010, which claims the benefit of U.S. Provisional Application No. 61/231,523, filed Aug. 5, 2009. Both applications are hereby incorporated by reference herein.

BACKGROUND

The present invention relates generally to printing presses and more particularly to stitching heads and stitchers in a printing press.

U.S. Pat. No. 4,196,835, hereby incorporated by reference herein, discloses a collating machine that includes a stitcher assembly which stitches a group of signatures while they are moving.

U.S. Pat. No. 4,708,277, hereby incorporated by reference herein, discloses a stitching head which includes a crank rotatable about a longitudinal axis through an oscillatory displacement in each of the opposite drive and return directions. The stitching head also includes a staple supporter, a staple former and a staple driver.

U.S. Pat. No. 5,361,962 purportedly discloses a rotatable wire holder for a stitching machine head that has a wire-receiving slot between two wire support surfaces and wire cam surfaces which guide the wire from the slot to the support surfaces in response to rotation of the holder. The holder is used in a stitching machine head including feed mechanism for gripping and feeding a length of wire from a continuous coil supply to the holder.

U.S. Pat. No. 7,032,898 purportedly discloses a wire-stitching apparatus for producing wire-stitched print items which includes a conveying arrangement for supplying folded, printed products in a straddling position, a wire-stitching unit installed at an adjustable distance above the conveying arrangement including a bending device, at least one wire-stitcher aggregate and a stitching carriage for moving the at least one wire-stitching aggregate back and forth along a path. A control unit measures the thickness of the printed products positioned on the conveying arrangement upstream of the wire-stitching unit and/or processes stored data related to the printed products.

U.S. Pat. No. 7,337,937 discloses a stitching apparatus having a stitching head body and a driver for driving the stitching wire staples into the stacked sheet materials in a downward movement of the driver. A former shapes the stitching wire staples and pivots away during downward movement of the driver.

BRIEF SUMMARY OF THE INVENTION

The present invention provides a stitching head for stitching books or printed products, the stitching head including a supporter, the supporter having a corrugated supporter surface including first ridges and first grooves and a driver for interacting with the supporter, the driver having a channel and a corrugated driver surface including second ridges and second grooves. The first grooves and first ridges of the supporter mesh with the second ridges and second grooves of the driver. The channel constrains stitching material between the corrugated supporter surface and the driver.

The present invention further provides a stitching head for stitching books or printed products, the stitcher including a two-part supporter including a supporter base and a supporter piece, a spring for spring-loading the supporter piece away from the supporter base, and a driver for interacting with the two-part supporter.

The present invention also provides a method of stitching a printed product or book using a saddle stitcher. The method includes the steps of inserting a stitching material into a stitching head, forming a stitch around a supporter of the stitching head using a former, cutting the stitching material, providing meshing engagement between a driver and the supporter via corresponding ridges and grooves in the driver and supporter and stitching a printed product or book.

The crown of a stitch often deforms during stitching when stitching books of heavy stock. By providing a stitching head having a corrugated supporter surface and a corrugated driver surface, in accordance with the present invention, the driver and supporter may mesh together, keeping the stitching material, for example, wire, tightly constrained therebetween. Tightly constraining the stitching material between the driver and supporter prevents the stitching material from buckling during stitching of a printed product or book.

In accordance with a further feature of the present invention, the supporter may be designed as a two-part supporter piece so a curved portion of the supporter can be replaced easily when needed. The supporter may also be spring loaded towards the driver to reduce gaps between the driver and supporter, compensate for wear in the stitching head and constrain the stitching material.

Another feature of the present invention includes providing a driver that is adjustable with respect to the former and supporter so the distance between the driver and the supporter can be changed readily.

BRIEF DESCRIPTION OF THE DRAWINGS

A preferred embodiment of the present invention will be elucidated with reference to the drawings, in which:

FIG. 15 includes a listing of parts shown in FIGS. 6A to 6C and 14A to 14G and their descriptions.

DETAILED DESCRIPTION OF A PREFERRED EMBODIMENT

Figure 1:
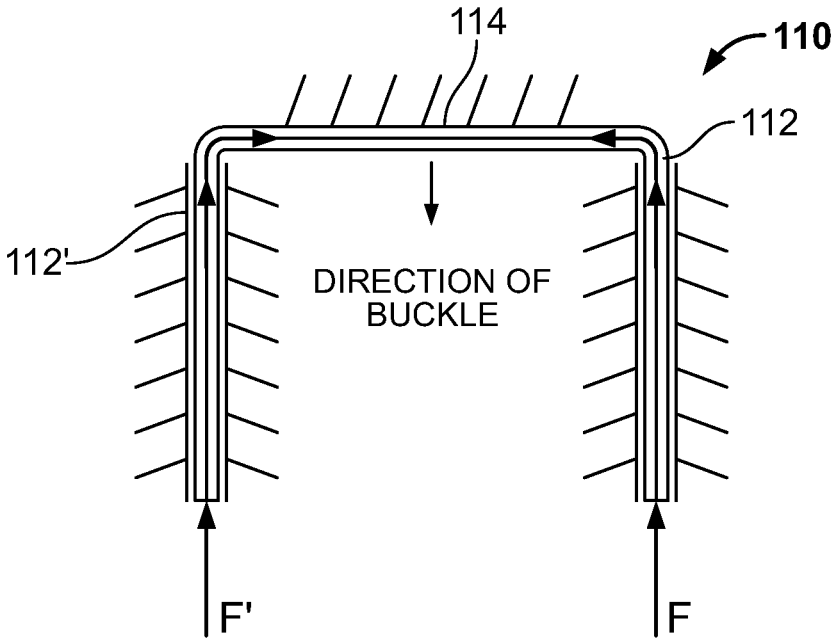
FIG. 1 schematically shows a stitch for binding a printed product or book.

FIG. 1 shows schematically a staple or stitch 110 for stitching printed products or books. The stitch has two legs, 112, 112' and a crown 114. The crown 114 extends between ends of the two legs 112, 112'. The stitch is made from one piece of stitching material, for example, wire, and bent into the inverted U shape shown in FIG. 1. Legs 112, 112' are forced through the printed product or book.

Figure 2:
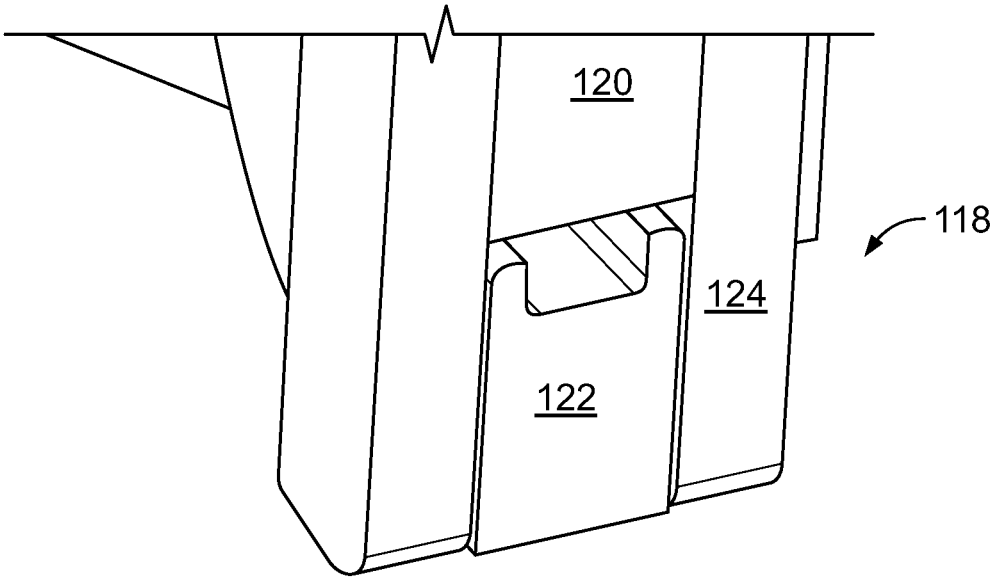
FIG. 2 (Prior Art)
FIG. 2 shows a former, supporter and driver according to the prior art.

FIG. 2 shows a stitching head in accordance with the prior art. Stitching head 118 includes a former 124, supporter 122 and a driver 120. The former 124 shapes legs 112, 112' around supporter 122. The former 124 and supporter 122 provide support so legs 112, 112' do not collapse or deform during stitching. The downward force of driver 120 pushes legs 112, 112' towards and into a book at a stitching location. When there is resistance from the book, forces F, F' go through legs 112, 112' since legs 112, 112' cannot collapse or deform. (FIG. 1). Crown 14 is only constrained from the top, so crown 14 deforms by extruding through an opening or space between driver 120 and supporter 122.

Figure 3:
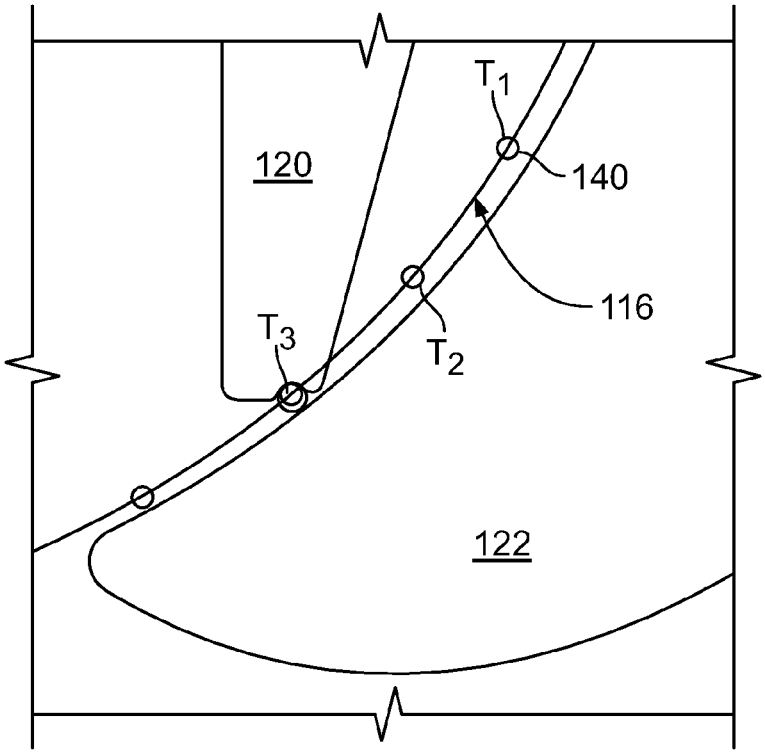
FIG. 3 (Prior Art)
FIG. 3; shows the trajectory of a stitching wire moving down a support according to the prior art.

FIG. 3 shows a wire trajectory path 116 for a stitching wire 140 in accordance with the prior art. Stitching wire 140 is shown at four positions in time. Stitching wire 140 enters at a top of stitching head 118 via side plates. Driver 120 engages stitching wire 140 and moves stitching wire 140 further down a surface of supporter 122 as shown at first, second, third and fourth positions in time, T1, T2, T3, T4. At a third position in time T3, there is a space of 0.023 inches between driver 120 and supporter 122 which permits wire 140 to move or play. Driver 120 continues to guide stitching wire 140 across 122 to a stitching location where wire 140 is driven into a book or printed product. As the stitching head components wear, the space or gap between driver 120 and supporter 122 increases. Stitching wire 140 may extrude through this opening which leads to deformed or undesirable stitches.

Figure 4:
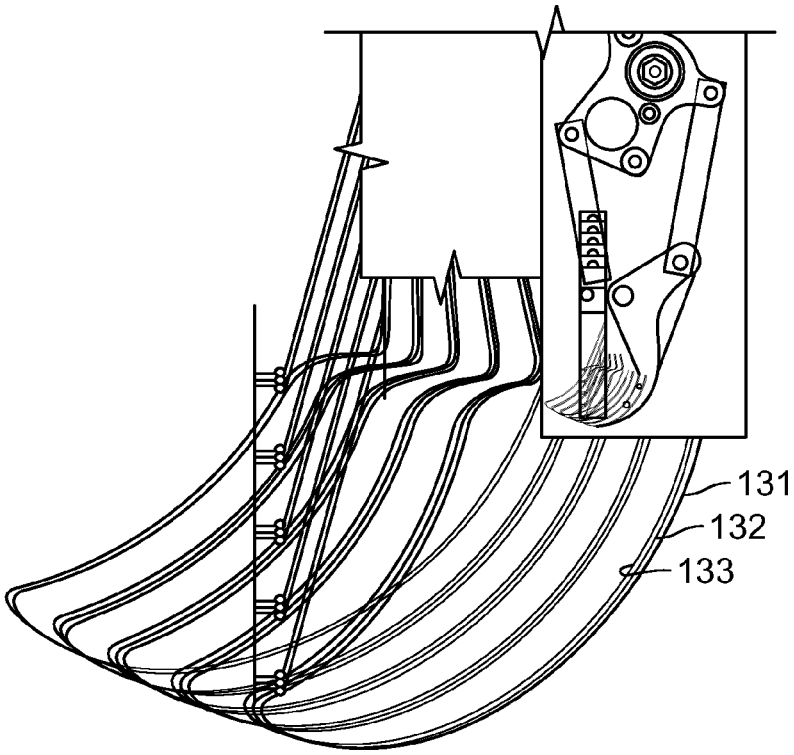
FIG. 4 shows the results of wear on bearings in the driver and supporter joints according to the prior art.

As shown in FIG. 4, a small amount of clearance may have significant impact on stitching head operation. Wear in the bearings of 0.005 inches shown by line 132 produces a clearance of 0.019 inches while wear in the bearing of 0.010 inches shown by line 133 produces 0.037 inches of clearance. Thus, on a stitcher head with only 0.005 inches of wear in the driver and supporter joints, stitches are deformed at the crown which is a chronic problem. On a stitcher head with almost no wear on the bearings or play between the driver and support as shown by line 131, deformation in the crown of the stitch is minimal.

Figure 5B:
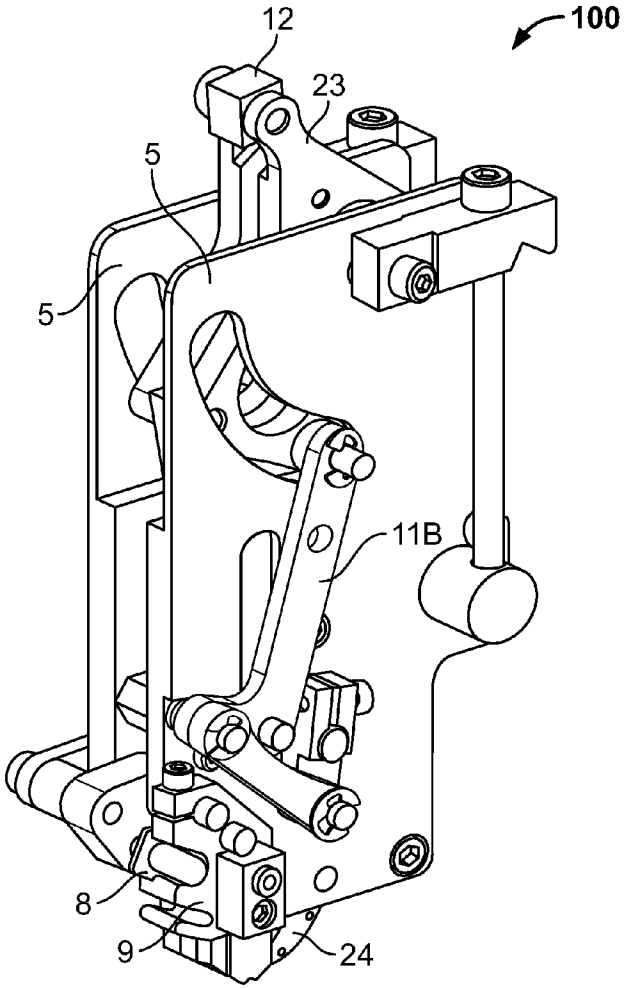
FIGS. 5A and 5B show a stitching head in accordance with the present invention.
Figure 5A:
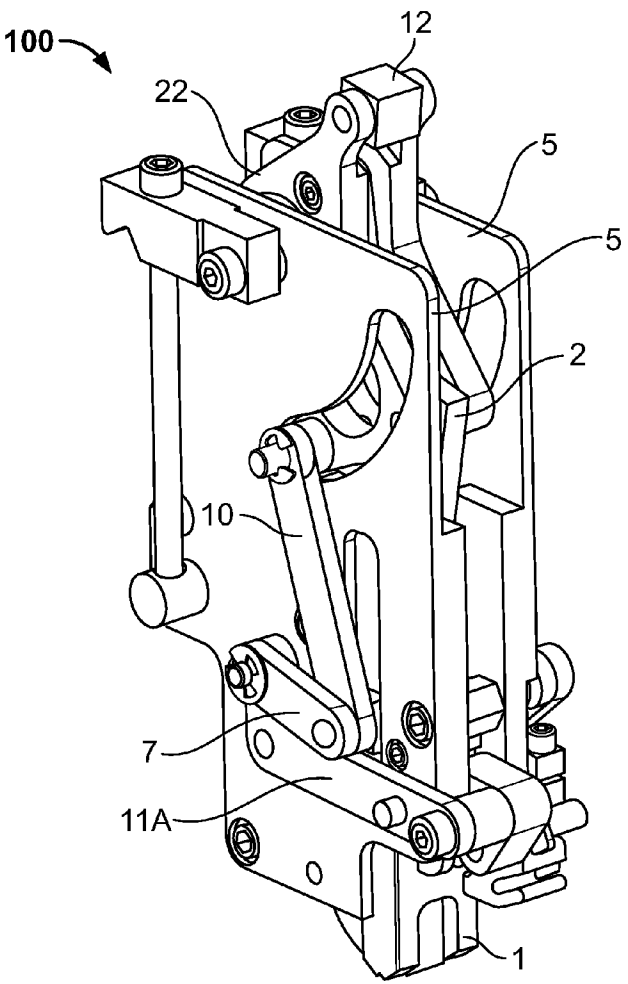

FIGS. 5A and 5B show a stitching head 100 in accordance with the present invention. Stitching head 100 includes side frames 5, a block drive 12, bell cranks 22, 23, a former 1, a supporter 24 and a plurality of links, levers and pins, including a cutter lever 11A, a former link 11B, a former link 10 and a cutter link 7. The parts and components of stitching head 100 are shown in more detail in FIGS. 6A to 6C and FIGS. 14A to 14G. Stitching head 100 may be incorporated into a saddle stitching device and used to stitch books or printed products on a saddle conveyor during post press operations.

Movement of block drive 12 actuates stitching head 100. Bell cranks 22, 23 rotate clockwise or counterclockwise based on the input received from block drive 12. The motion of bell cranks 22, 23 activates links inside and outside side frames 5. A stitching material, for example, a stitching wire enters through a side frame 5 and is cut to a desired length by a blade 8 of cutter 9 which is mounted on side frame 5. The stitching wire is then shaped around former 1 and supporter 24 to form a stitch. A driver 27 (FIGS. 6A to 6C) constrains stitching wire across a surface of a supporter piece 26 and moves wire down across a surface of supporter piece 26 to a stitching location at a book or printed product.

Figure 6A:
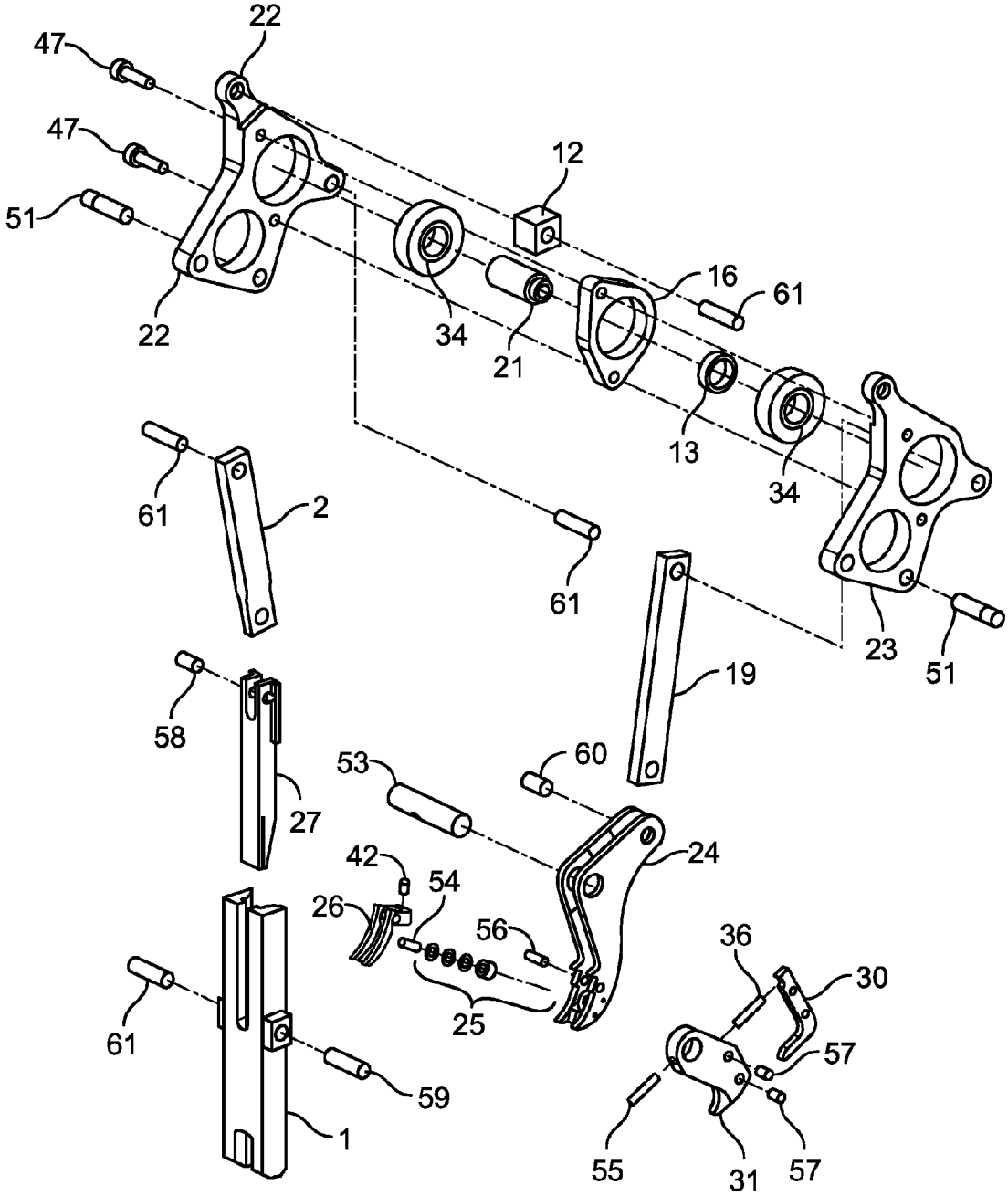
FIGS. 6A to 6C show exploded views of components of the stitching head shown in FIG. 5.
Figure 6B:
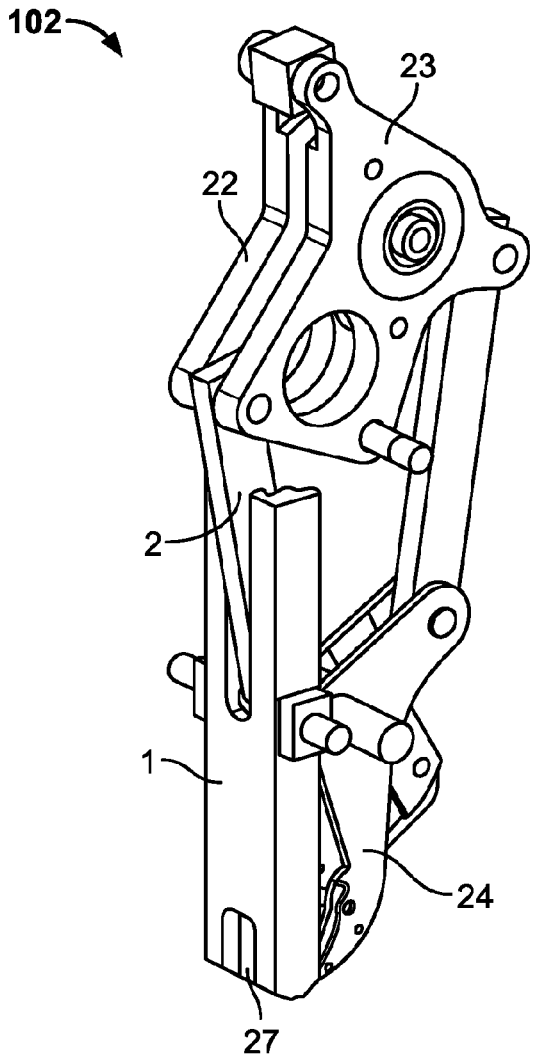
Figure 6C:
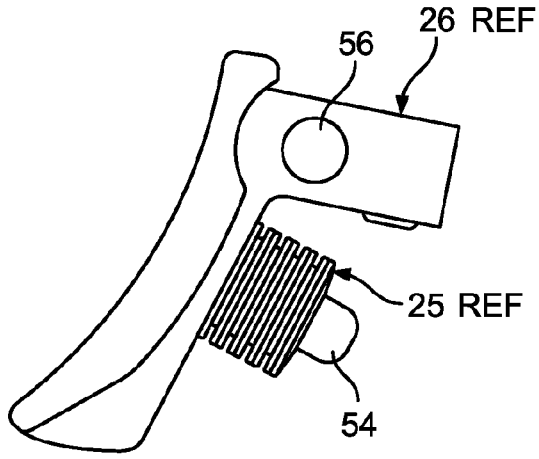

FIGS. 6A to 6C show an exploded view of components of the stitching head shown in FIG. 5. FIG. 6B shows assembled components of stitching head 100 which are mounted inside side frames 5. As shown in FIG. 6A, bell cranks 22, 23 are connected to drive block 12 via bearings 34 and spacers 13, 16 using pins, pivots and studs. A driver link 2 and supporter link 19 are pinned to bell cranks 22, 23, respectively. Driver link 2 is pinned to driver 27 and supporter link 19 is connected to supporter 24. Supporter 24 is a two-part piece and includes a supporter piece 26. Once assembled, as shown in FIG. 6B, driver 27 moves up and down inside former 1 to make contact with supporter piece 26 in order to constrain, control and move stitching material.

FIG. 6A also shows supporter 24 in more detail. Supporter 24 includes a corrugated supporter piece 26 which is rotatably pinned to supporter 24 via pin 56. Both supporter piece 26 and a tip of driver 27 are corrugated. The corrugated surfaces of each piece 26, 27 mesh together when supporter piece 26 and driver 27 are engaged. (See also FIGS. 9 and 10).

In accordance with a preferred embodiment of the present invention, supporter piece 26 is spring loaded away from supporter 24 and toward driver 27. As shown if FIG. 6C, springs 25, for example, Belleville springs, are mounted via pin 54 and force corrugated support piece 26 out, away from supporter 24 towards driver 27 when stitching head 100 is assembled. Spring-loading corrugated supporter piece 26 towards driver 27 promotes contact between supporter piece 26 and driver 27 so stitching material is more tightly constrained along the crown of a stitch thereby reducing deformations in the stitches. In addition, spring loading supporter piece 26 towards driver 27 compensates for slack and play in the stitching head even after bearings and joints in stitching head 100 have worn down.

Figure 8:
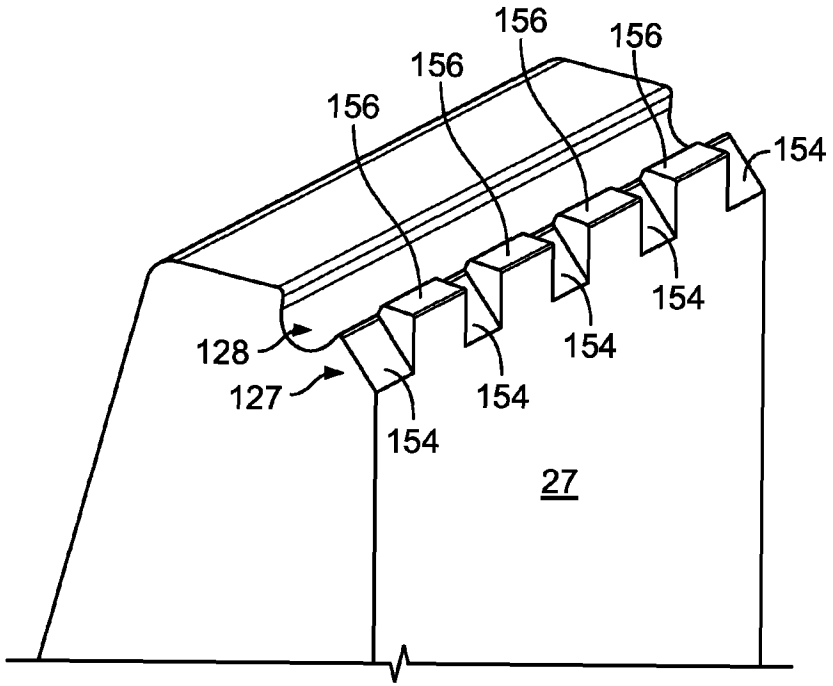
FIG. 8 shows an end of a driver of the stitching head shown in FIG. 5.
Figure 7:
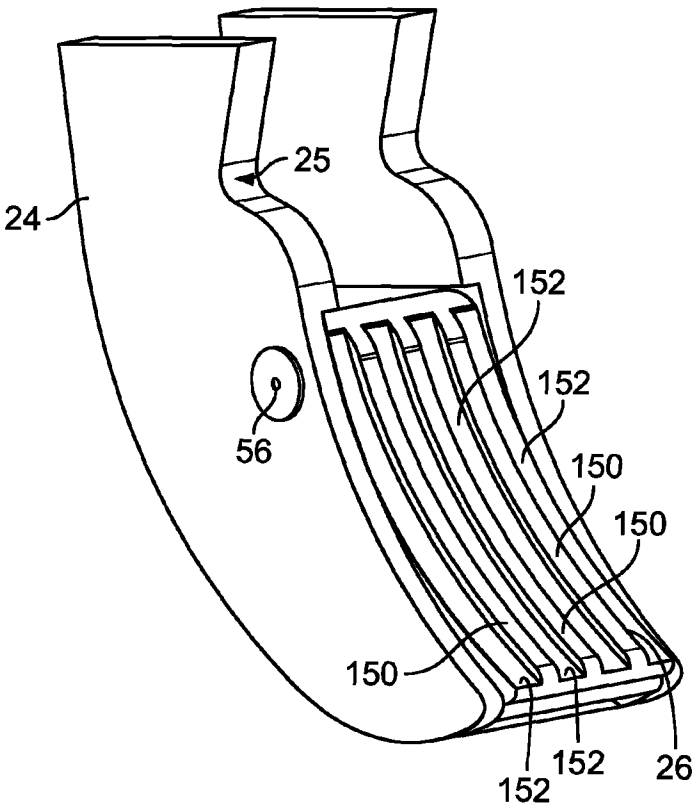
FIG. 7 shows a supporter of the stitching head shown in FIG. 5.

FIG. 7 shows supporter 24, including corrugated support piece 26 and pin 56. Supporter 24 includes a nook 25 for receiving stitching material 80 via side plates 5 of stitching head 100. The corrugations on support piece 26 include ridges 150 and grooves 152. The ridges 150 and grooves 152 correspond to grooves 154 and ridges 156, respectively, on an engaging end 127 of driver 27 as shown in FIG. 8. When driver 27 contacts supporter piece 24, grooves 152 receive ridges 156 and the grooves 154 receive ridges 150 so an engaging end 127 of driver 27 is in meshing engagement with corrugated supporter piece 26. Stitching material 80 enters through nook 25 in supporter 24 and is constrained between driver 27 and supporter piece 26, in a channel 128 of driver 27 (FIGS. 8 and 9).

Figure 9:
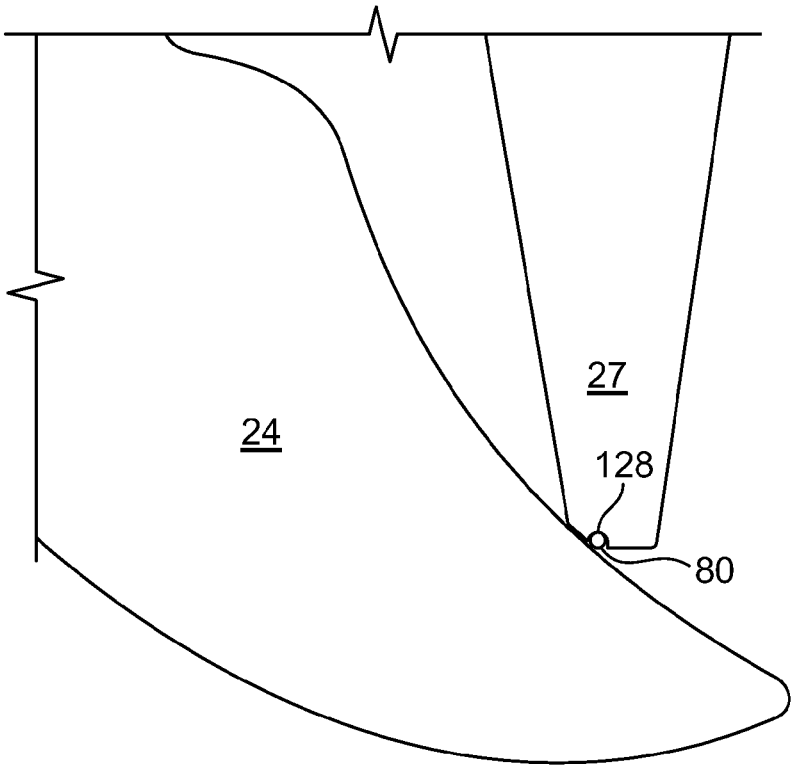
FIGS. 9 and 10 show the driver and supporter shown in FIGS. 7 and 8.
Figure 10:
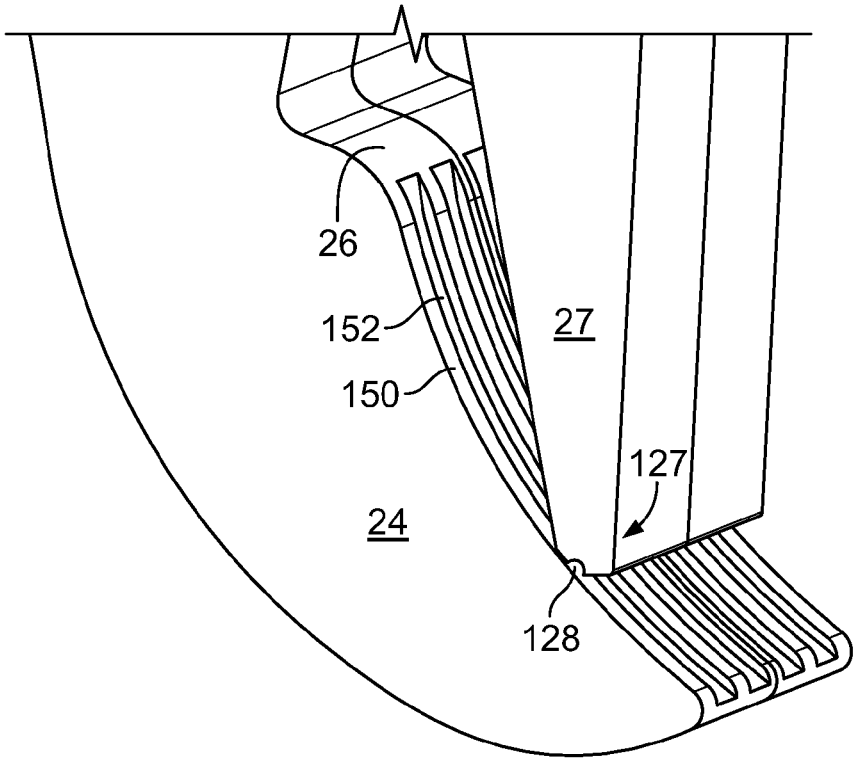

FIG. 9 shows a side view of supporter 24 in meshing engagement with driver 27. Driver 27 moves down a surface of corrugated supporter piece 26. A stitching material 80 is constrained in channel 128. Similarly, FIG. 10 shows a perspective view of supporter 24 including supporter piece 26 in meshing engagement with engaging end 127. The groove and ridge of corrugated engaging end 127 mesh with the ridges 150 and grooves 152 of supporter piece 26. Stitching material is constrained and supported in channel 128 from above by driver 27 and from below by ridges 150. In addition, the gap or clearance between driver 27 and supporter piece 26 is reduced which is shown in more detail in FIGS. 12, 13A and 13B.

Figure 11:
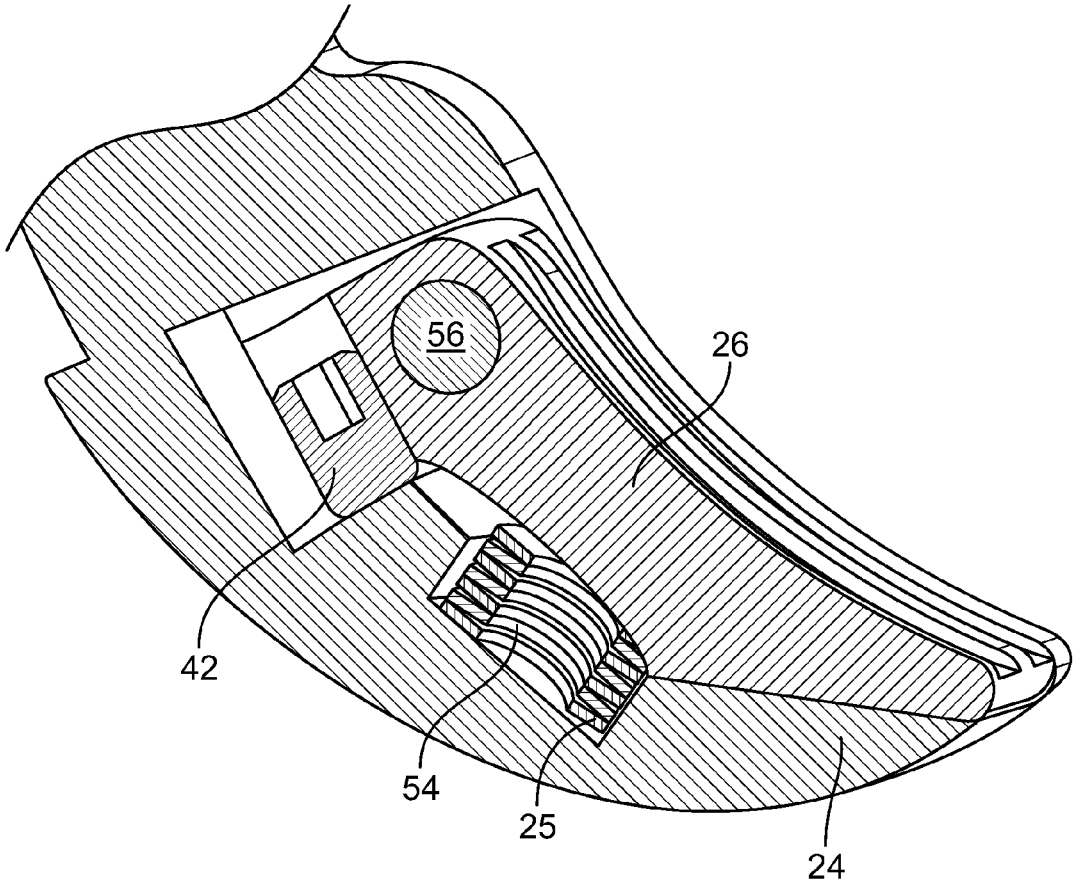
FIG. 11 shows a cutaway view of the supporter shown in FIG. 7.

FIG. 11 shows a cutaway view of supporter 24 including supporter piece 26, springs 25, pin 54, pin 56 and screw 42. As previously discussed above, supporter piece 26 is spring loaded via springs 25 and pin 54 away from supporter 24.

Figure 12:
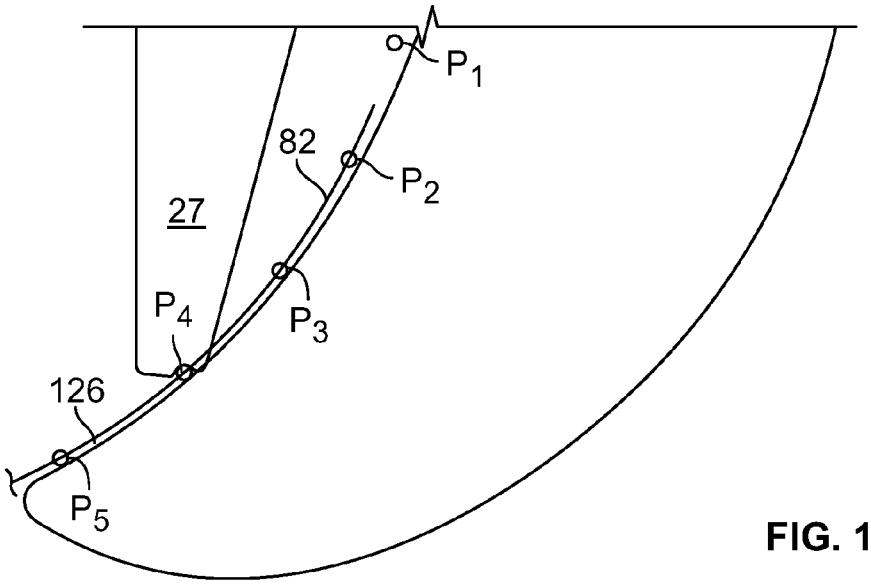
FIG. 12 shows the trajectory of a stitching material moving down a supporter of the stitching head shown in FIG. 5.

FIG. 12 shows a trajectory of stitching material 80 down supporter 24 at six positions in time, P1, P2, P3, T4, P5. A curvature of surface 126 has been optimized for movement of stitching material 80 along a wire trajectory 82. Stitching material 80 enters the stitching head at nook 25 (FIG. 7) in supporter 24 and is formed into stitches around former 1 (see FIG. 6A) and supporter 24 prior to a first position in time P1. Driver 27 engages stitching material 80 and, as time increases, moves stitching material 80 down trajectory 82 as shown at P1, P2, P3 and P4. Driver 27 engages stitching material 80 and constrains material 80 against a surface 126 of supporter piece 26, and more specifically, material 80 is constrained in channel 128 against ridges 150 of supporter piece 26. By providing a corrugated surface on engaging end 127 and supporter piece 26 the driver 27 and supporter 24 can come closer together and more tightly constrain material 80 down trajectory 82 and into a stitching location.

Figure 13A:
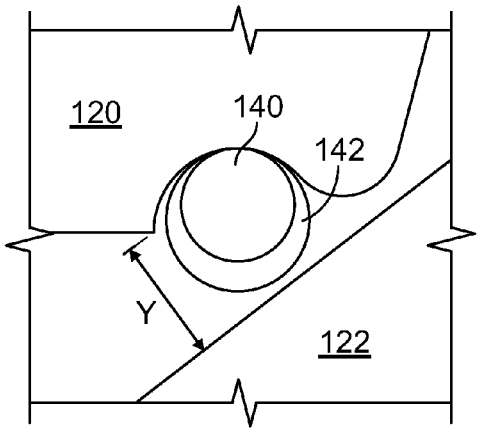
FIG. 13A (Prior Art)
FIG. 13A shows a stitching head in accordance with the prior art engaging a stitching material.

FIG. 13A shows a driver 120 engaging stitching material 140, 142 in accordance with the prior art. A distance Y between driver 120 and supporter 122 may be, for example, 0.023 inches as discussed above with respect to FIG. 3. Material 140 has a diameter shorter than material 142 and the two materials 140, 142 are shown together for comparison. In accordance with the prior art, drivers 120 may have been designed to accommodate various sized materials 140, 142. The design must accommodate the larger material 142 thus providing a larger space of clearance between the driver 120 and supporter 122. This may cause deformation especially when a smaller material 140 is used in the stitching head.

Figure 13B:
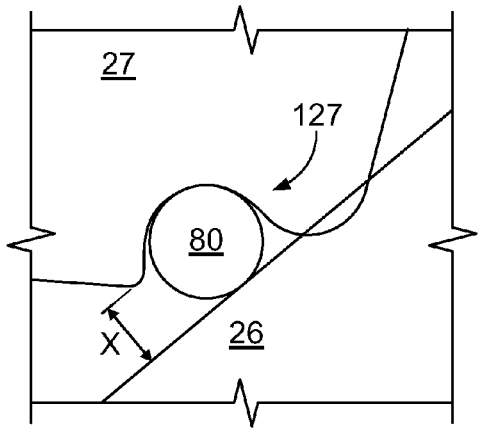
FIG. 13B shows a stitching head in accordance with the present invention engaging a stitching material.

As shown in FIG. 13B, in accordance with a preferred embodiment of the present invention, stitching material 80 is tightly constrained between an engaging end 127 of driver 27 and supporter piece 26. A distance X may be, for example, 0.012 inches. The ridges and grooves of supporter piece 26 and engaging end 127 mesh together so there is flush contact, in contrast to the prior art in which the driver 120 and supporter 122 do not contact each other. In addition, the spring-loading of supporter piece 26 helps ensure the meshing engagement of the ridges and grooves even after there is wear and play in stitching head 100.

Figure 14A:
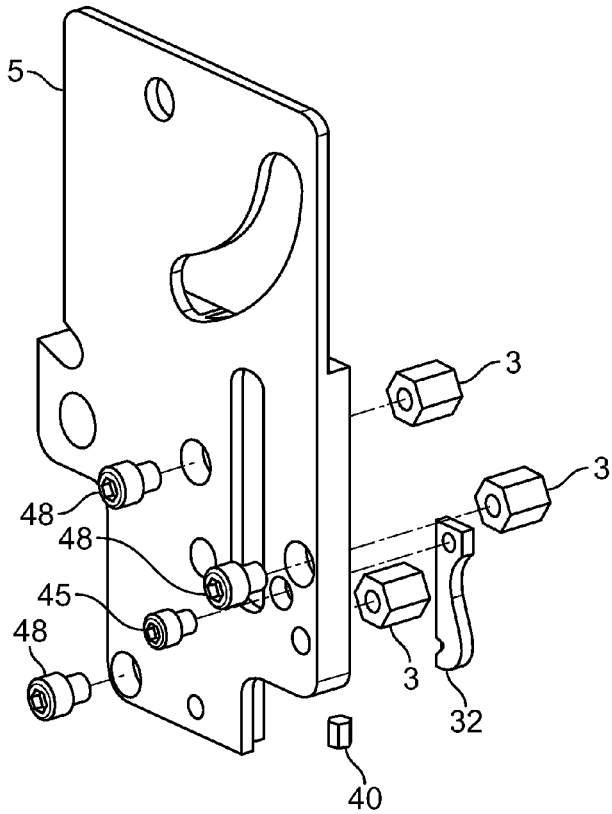
FIGS. 14A to 14G show the stitching head shown in FIGS. 5A and 5B in more detail.
Figure 14C:
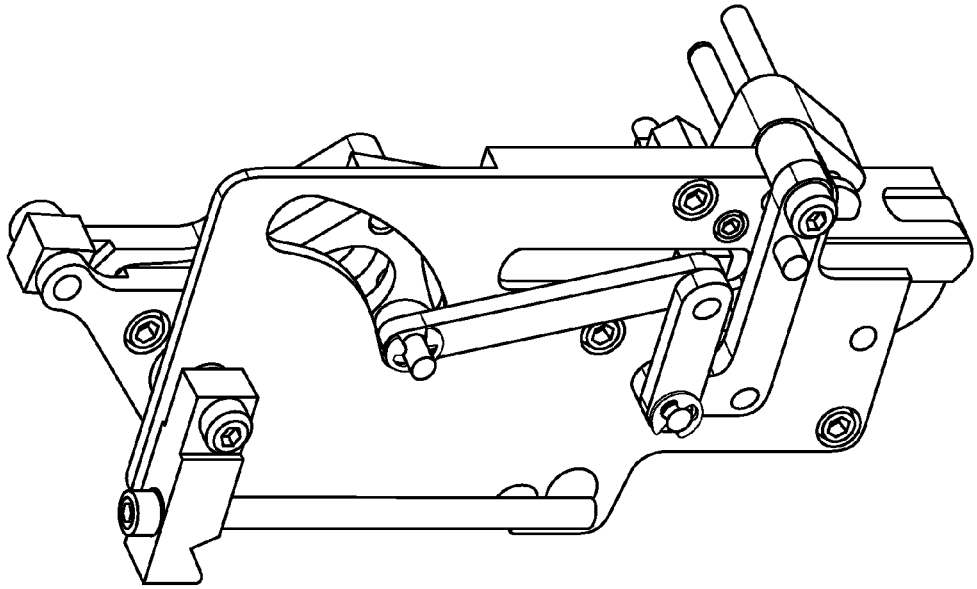
Figure 14B:
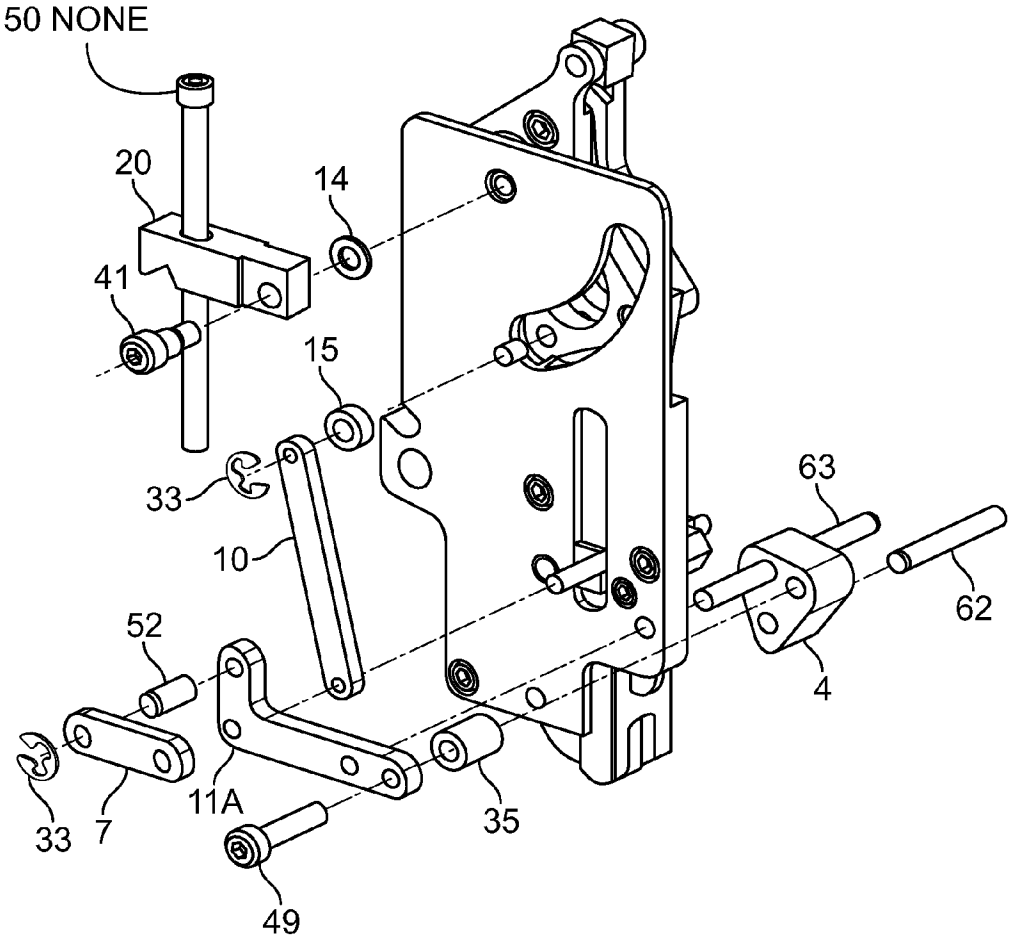
Figure 14E:
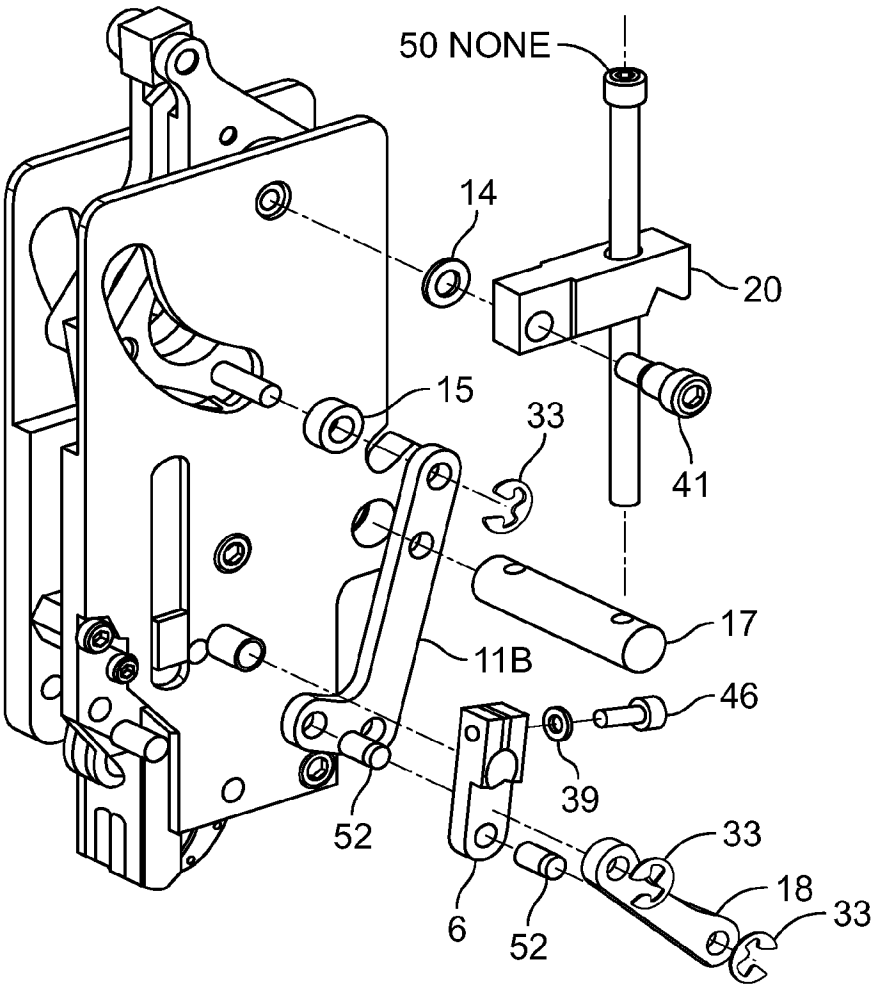
Figure 14D:
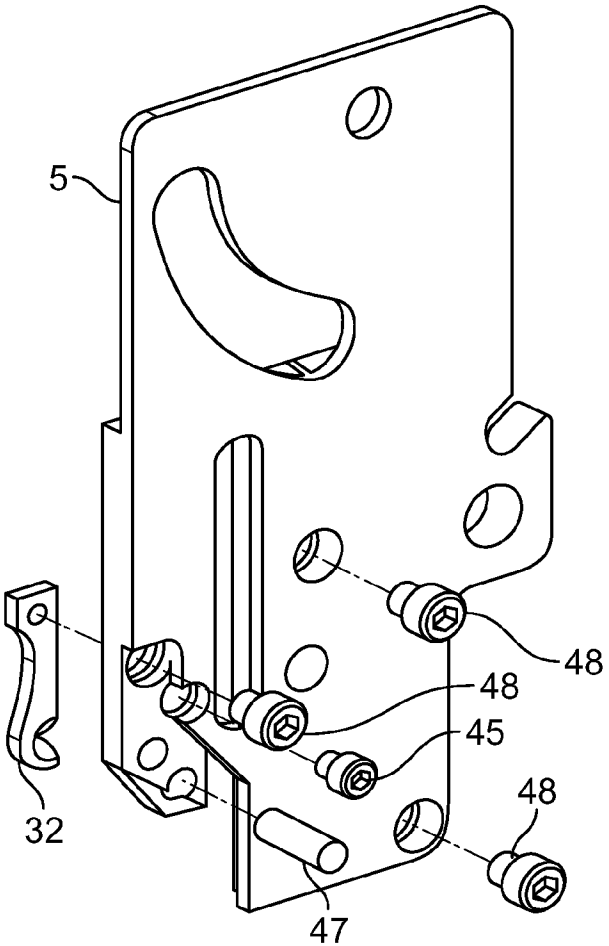
Figure 14G:
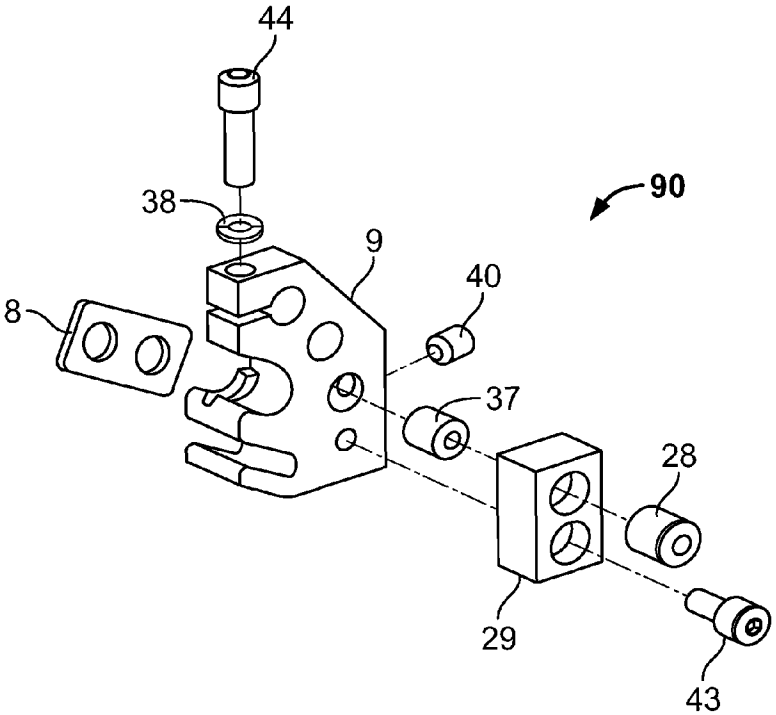
Figure 14F:
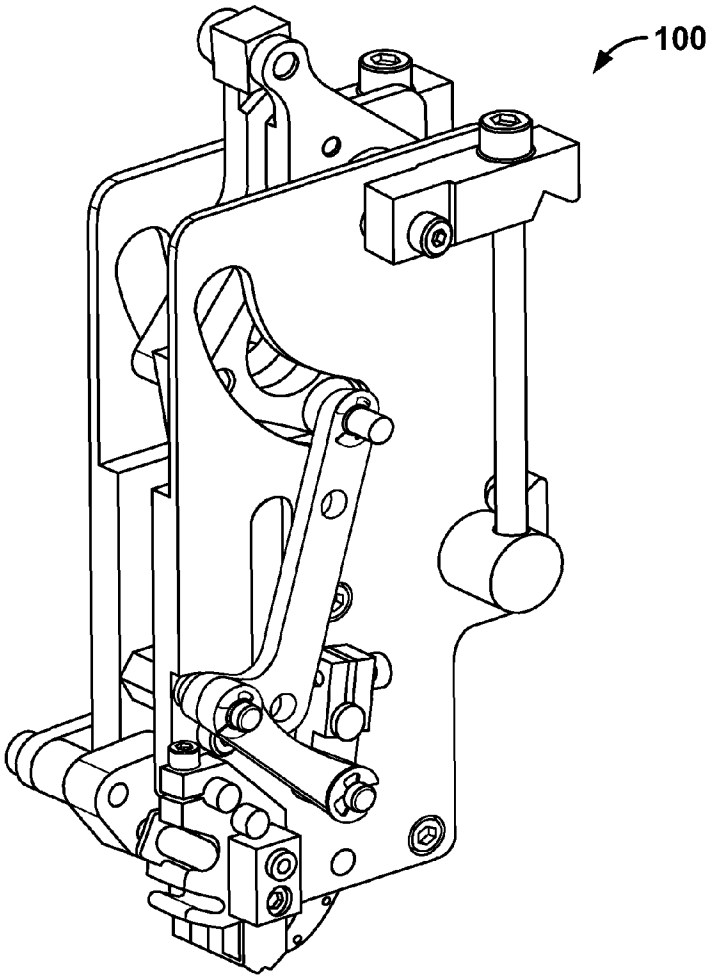

FIGS. 14A, 14B, 14D and 14E show an exploded view of the components of stitching head 100, more specifically, components mounted on the external sides of frames 5. FIG. 14C shows an assembled portion of stitching head 100. FIG. 14F shows stitching head 100 fully assembled. FIG. 14G shows a cutter 90 of stitching head 100 and corresponding components.

FIG. 15 includes a listing of parts used in stitching head 100 and shown in FIGS. 6A to 6C and 14A to 14G.

Figure 16:
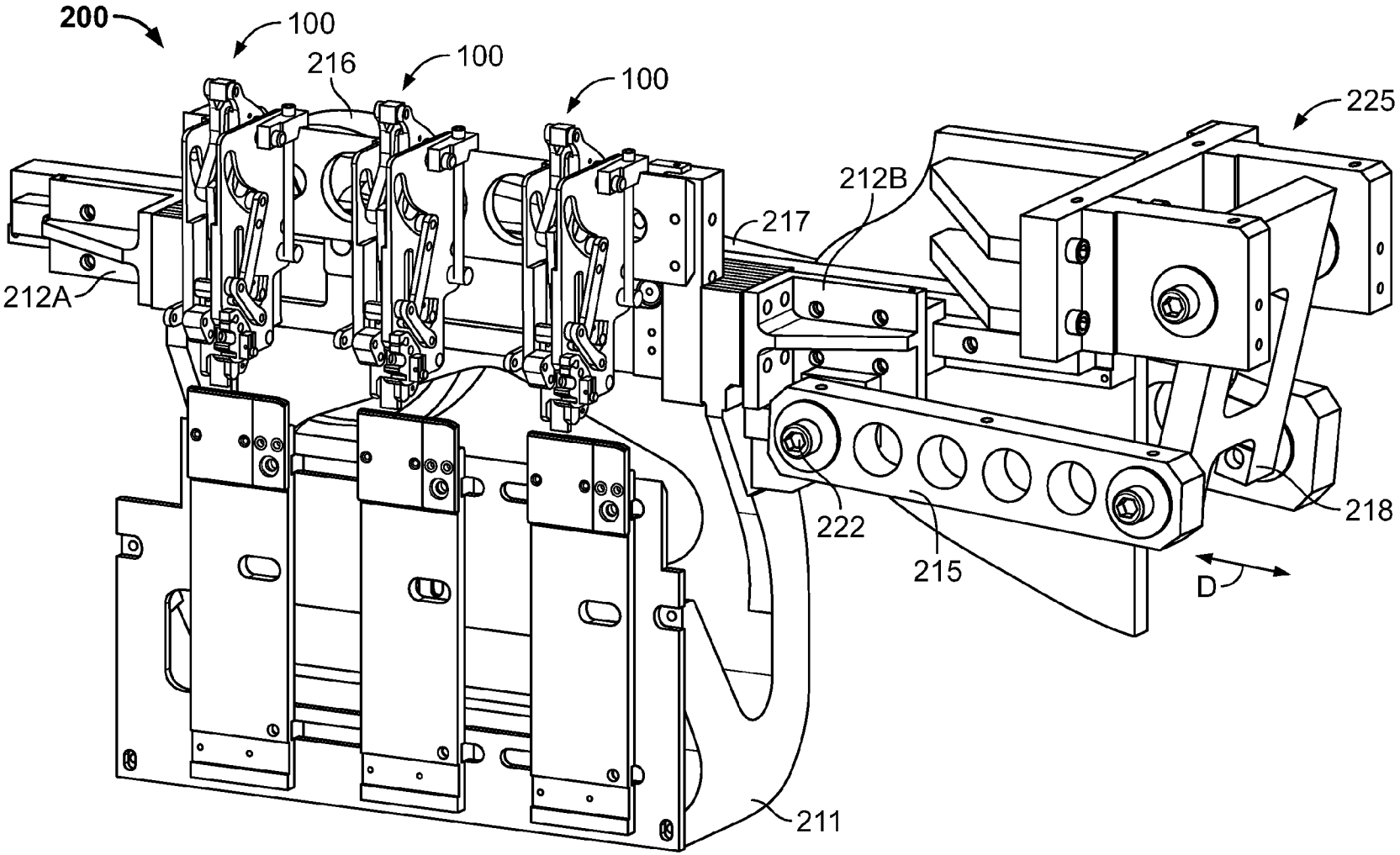
FIGS. 16 and 17 show saddle stitchers, each saddle stitcher includes a plurality of the stitching heads shown in FIGS. 5A and 5B.

FIG. 16 shows a saddle stitcher 200 including three stitching heads 100 in accordance with the present invention.

Figure 17:
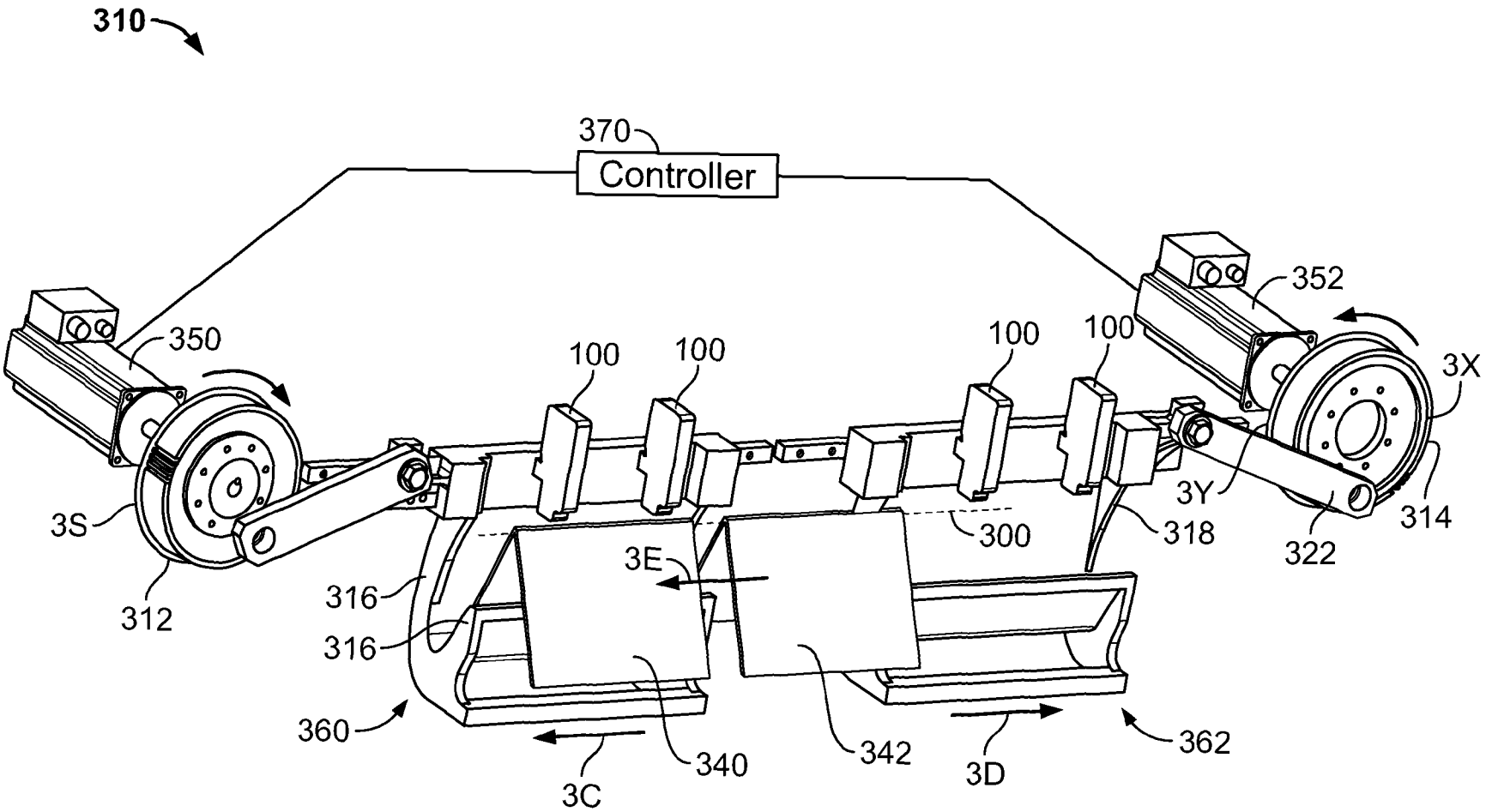

FIG. 17 shows a saddle stitcher 310 including four stitching heads 100 in accordance with the present invention.

In the preceding specification, the invention has been described with reference to specific exemplary embodiments and examples thereof. It will, however, be evident that various modifications and changes may be made thereto without departing from the broader spirit and scope of invention as set forth in the claims that follow. The specification and drawings are accordingly to be regarded in an illustrative manner rather than a restrictive sense.

What is claimed is:

1. A saddle stitcher for stitching books or printed products comprising:

a saddle conveyor for transporting printed products; and at least one stitching head including:

a two-part supporter including a supporter base and a supporter piece; the supporter piece including a corrugated surface, a spring for spring-loading the supporter piece away from the supporter base; and a driver for interacting with the two-part supporter, a tip of the driver including a corrugated surface.

2. The saddle stitcher for stitching books or printed products as recited in claim 1, wherein the corrugated surfaces of the support piece and driver tip mesh together when the supporter piece and driver are engaged.

3. The saddle stitcher for stitching books or printed products as recited in claim 2, wherein the driver moves along the corrugated surface of the supporter piece.

4. The saddle stitcher for stitching books or printed products as recited in claim 1, wherein the supporter piece is rotatably connected to the supporter base.

5. The saddle stitcher for stitching books or printed products as recited in claim 1, wherein the supporter piece is spring loaded toward the driver.

6. The saddle stitcher for stitching books or printed products as recited in claim 1, wherein the supporter includes a receiving area or nook for receiving stitching material.

7. The saddle stitcher for stitching books or printed products as recited in claim 1, wherein the driver includes a channel for holding stitching material.

8. The saddle stitcher for stitching books or printed products as recited in claim 7, wherein the supporter piece and driver are in contact with one another while stitching material is contained in the channel.

9. The saddle stitcher for stitching books or printed products as recited in claim 7, wherein the channel accommodates a plurality of sizes of stitching material.

10. The saddle stitcher for stitching books or printed products as recited in claim 1, wherein the at least one stitching head is three or four stitching heads.

11. The saddle stitcher for stitching books or printed products as recited in claim 1, wherein the driver constrains stitching material against the corrugated surface of the supporter piece.

12. A saddle stitcher for stitching books or printed products comprising:

a saddle conveyor for transporting printed products; and at least one stitching head including:

a two-part supporter including a supporter base and a supporter piece, the supporter piece including first ridges and first grooves a spring for spring-loading the supporter piece away from the supporter base; and a driver for interacting with the two-part supporter.

13. A saddle stitcher for stitching books or printed products comprising:

a saddle conveyor for transporting printed products; and at least one stitching head including:

a two-part supporter including a supporter base and a supporter piece;

a spring for spring-loading the supporter piece away from the supporter base; and a driver for interacting with the two-part supporter, the driver including second ridges and second grooves.

* * * * *